US005297954A

United States Patent [19]

Colagiovanni

[11] Patent Number: 5,297,954

[45] Date of Patent: Mar. 29, 1994

[54] VOLATILE ORGANIC COMPOUND ABATEMENT SYSTEM

[75] Inventor: Frank M. Colagiovanni, Washington, Mich.

[73] Assignee: Haden Schweitzer Corporation, Madison Heights, Mich.

[21] Appl. No.: 29,692

[22] Filed: Mar. 11, 1993

[51] Int. Cl.[5] ..... F23D 14/00

[52] U.S. Cl. ..... 431/5; 110/211; 110/212; 110/214; 422/173

[58] Field of Search ..... 431/5, 170; 110/211, 110/212, 214; 422/173, 174, 175

[56] References Cited

U.S. PATENT DOCUMENTS 5,101,741 4/1992 Gross et al. ..... 431/5 X

*Primary Examiner*—Edward G. Favors
*Attorney, Agent, or Firm*—Niro, Scavone, Haller & Niro

[57] ABSTRACT

A volatile organic compound (VOC) abatement system is provided which incorporates a carbon or zeolite type concentrating adsorption device, with VOCs collected upon the adsorption surfaces. A heat source is required heat gases flowing to the adsorption device in order to remove the concentrated VOCs. Also, heat is required to oxidize the VOCs into a safe form prior to their release into the atmosphere. The present invention employs a regenerative thermal oxidizer for efficiently combusting the VOCs prior their release into the atmosphere. The present system also employs a bypass valve for introducing a portion of the VOCs directly into a combustion chamber without regenerative preheating. The resulting lowering of thermal efficiency of the regenerative thermal oxidizer allows the exhaust from the regenerative thermal oxidizer to carry more thermal energy. The thermal energy from the exhaust is then transferred to a heat exchanger to heat gasses flowing into the adsorption device.

8 Claims, 2 Drawing Sheets

VOLATILE ORGANIC COMPOUND ABATEMENT SYSTEM

BACKGROUND OF THE INVENTION

This invention relates to a method and apparatus for treating a waste stream containing volatile organic compounds ("VOC").

Treatment of waste in industrial facilities causes a multitude of environmental and economic problems. Over the years, increasingly strict governmental pollution guidelines, as well as increased costs of waste disposal, have led to escalating concern in waste treatment. The difficulty in disposing of gaseous waste materials is increased when the waste includes dilute concentrations of VOCs. Under these circumstances, it is desireable to first concentrate the VOCs through the use of carbon, zeolite or other adsorption media.

Heated desorption gases are thereafter used to remove VOCs from the adsorption media and create a VOC laden effluent. The effluent is then oxidized, or combusted, to destroy the VOCs prior to discharge into the atmosphere.

Problems in the treatment of VOC waste streams, such as that of paint spray booth facilities, arise in the context of trying to simultaneously maximize the thermal efficiency of the waste treatment process and attempting to minimize the use, complexity and cost of the system. Some prior art systems have employed regenerative thermal units to oxidize VOCs. However, VOC abatement systems which currently use regenerative thermal units for oxidizing VOC require additional equipment, such as a "desorption heater" for providing the heated desorption air. Additionally, the pressure drop experienced across the regenerative thermal unit requires larger motors and fans, thus increasing the initial and operational costs of the system.

Alternatively, prior art VOC abatement systems have utilized a recuperative thermal oxidizer in combination with a heat exchanger for heating desorption gasses. However, these systems sacrifice thermal efficiency of the system. Typically, recuperative units will achieve no more than 70% thermal efficiency, whereas their regenerative thermal oxidizer counterparts achieve 90% to 95% efficiency.

No prior art system has been developed for oxidizing VOCs which incorporates the thermal efficiency of regenerative thermal oxidizers while maintaining the design simplicity and cost efficiency of recuperative thermal oxidizers. It is, therefore, desirable to provide a method and apparatus which effectively and economically oxidizes VOC waste streams. It is also desirable to provide a method and apparatus which oxidizes VOC waste streams while utilizing a design with minimal complexity and weight.

SUMMARY OF THE INVENTION

The present invention is directed to an apparatus and method for treating VOC waste streams. In accordance with the present invention, the VOCs are removed from adsorption units through the introduction of heated desorption gasses. The resulting VOC laden effluent is further heated in at least one regenerative thermal bed, and then is oxidized in a combustion chamber. The resulting effluent is then transported through a heat exchanger in order to recover some of the thermal energy from the oxidization process and utilize the thermal energy to heat the desorption gasses headed into an adsorption unit.

The present invention is directed further to a method and apparatus using a regenerative thermal oxidizer unit in which the thermal efficiency of the unit may be selectively reduced in order to recover and use thermal energy elsewhere in the abatement system in place of other heat sources. Thus, the method and apparatus of the present invention, through reducing the thermal efficiency of the regenerative thermal oxidizing unit, yields significant benefits in terms of reducing equipment weight and size. Also, the reduced efficiency of the regenerative oxidizing unit results in a lower pressure drop across the unit, thus, reducing the capital and operating cost required to maintain needed static pressure in the VOC abatement system.

In accordance with the present invention, a desorption gas (typically, air) is heated by a heat exchanger and directed into an adsorption unit to remove VOCs from the carbon, zeolite or other adsorption media. The VOC-laden effluent of the adsorption unit is then introduced into a regenerative thermal oxidizing unit. The effluent is preheated in at least one regenerative thermal bed in the regenerative thermal oxidizing unit prior to combustion, but some of the effluent may, as required, bypass the bed and pass directly into the combustion chamber. As a result, the thermal efficiency of thermal oxidizing unit is reduced, thus, providing excess thermal energy in the oxidized effluent. The hot oxidized effluent from the regenerative thermal oxidizing unit is then used as a heat source in the desorption gas.

In the preferred embodiment of the invention, the system includes a VOC adsorption unit, an inlet for receiving desorption gases into the adsorption unit, and heat exchanger to heat the desorption gases heading for the adsorption unit. The VOC laden effluent is then transferred from the adsorption unit to a thermal regenerative oxidizing unit. Thermal regenerative beds within the oxidizing unit heat some of the effluent prior to oxidation within the combustion chamber of the oxidizing unit, while a bypass valve routes the remainder of the effluent directly into the combustion chamber of the oxidizing unit. The heat exchanger for heating air heading into the adsorption units then recovers heat from the combusted effluent prior to the effluent's discharge from the system. The system also includes a controller which determines the extent to which the bypass valve operates, and thus the amount of heat to be transferred in the heat exchanger, based upon the temperature of the desorption gas leaving the heat exchanger, which is sensed by the controller.

In the preferred method of practicing the disclosed invention, desorption gas (typically, air) is first introduced to a heat exchanger. The heated desorption gas is then transferred from the heat exchanger to an adsorption unit to remove volatile organic compounds. The now VOC laden effluent is introduced from the adsorption unit to a regenerative heating bed for heating prior to combustion. The effluent is then directed from the regenerative thermal bed to the combustion chamber for oxidation. The method also comprises selectively bypassing a predetermined amount of the effluent around the regenerative thermal beds and directly into the combustion chamber, thus lowering the thermal efficiency of combustion and requiring excess thermal energy for combustion. The extent to which bypassing takes place is determined by sensing the amount of thermal energy in the heated desorption gases. The effluent is then oxidized. The oxidized effluent is then directed back through a different regenerative thermal bed and through a heat exchanger to transfer heat to desorption gases entering an adsorption unit. Finally, the oxidized effluent is discharged into the atmosphere.

Therefore, one object of the present invention is to treat a VOC waste stream through the use of a regenerative thermal oxidizer in a way that provides heat energy for use elsewhere within the abatement system.

It is still a further object of the present invention to provide a method and apparatus for the treatment of VOC waste streams wherein a selected desorption gas temperature is maintained by selectively bypassing VOC laden effluent around regenerative thermal beds and directly into the combustion chamber of a regenerative thermal oxidizing unit.

Other aspects and advantages of the present invention will become apparent from further disclosure of the preferred embodiment.

BRIEF DESCRIPTION OF THE DRAWINGS

The novel features of the invention are set forth in the appended claims. However, the preferred embodiments of the invention, together with further objects and advantages thereof, will best be understood by references to the following description, taken in connection with the accompanying drawings in which:

DESCRIPTION OF THE PREFERRED EMBODIMENTS

Figure 1:
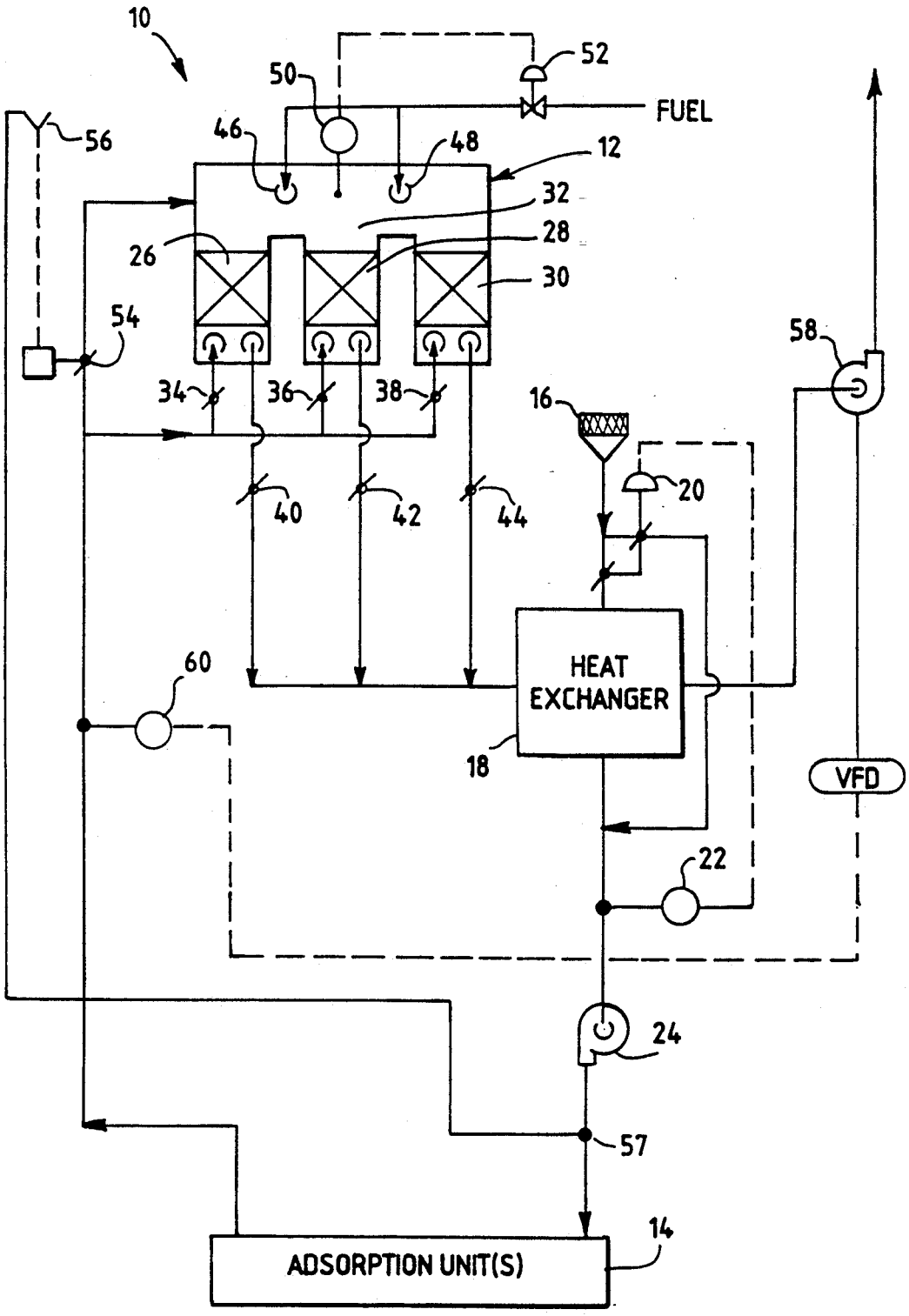
FIG. 1 is a schematic diagram illustrating one embodiment of the invention.

Referring to FIG. 1, a VOC abatement system is generally identified by 10. The system 10 receives air through a desorption air inlet 16. The desorption air is typically preheated in a heat exchanger 18 prior to being directed into the adsorption unit 14 by the desorption air supply fan 24. Alternatively, if the temperature of the desorption air drawn from the heat exchanger 18 is too hot, as determined through a temperature controller 22, all or part of the desorption air can be routed around the heat exchanger 18 by means of a heat exchanger bypass valve 20. The heated desorption air then enters the adsorption unit 14 and removes VOCs from the adsorption media contained in the unit. The resulting VOC-ladened effluent then proceeds to the regenerative thermal oxidizer 12 for combustion prior to discharge into the atmosphere.

The regenerative thermal oxidizer 12 is typically composed of three regenerative beds 26, 28 and 30, each bed typically containing ceramic heat-retaining elements, so as to preheat the VOC-ladened effluent air prior to combustion. Each of the regenerative thermal beds lead into a combustion chamber 32 (containing burners 46 and 48) maintained at a constant predetermined temperature through the use of a temperature controller 50 communicating with a fuel valve 52 for supplying the burners. Each of the regenerative beds 26, 28 and 30 have an inlet valve 34, 36 and 38, respectively, as well as an outlet valve, 40, 42 and 44, respectively. Typically, one regenerative thermal bed will have its inlet open, so as to receive the VOC-ladened effluent while a different regenerative thermal unit will have its outlet open, so as to discharge the oxidized effluent from the combustion chamber 32. Thus, the heat of combustion in the combustion chamber 32 is recovered in the regenerative thermal bed through which the combusted gasses exit. The heated thermal bed is then later utilized as an inlet to preheat VOC-ladened effluent headed into the combustion chamber. Thus, at any one time, at least one regenerative thermal bed is acting as an inlet chamber preheating the VOC-ladened effluent and at least one regenerative thermal bed is acting as an outlet chamber recapturing the thermal energy of the combustion gasses prior to their discharge into the atmosphere.

In accord with the present invention, a predetermined portion of the VOC-ladened effluent may be introduced into the combustion chamber 32 without passing through one of the regenerative thermal oxidizer beds 26, 28 or 30. This is accomplished by means of a two-position bypass valve 54, based upon the thermal energy needs of the desorption gas as sensed by a controller 56. The controller includes a temperature sensor 57 which measures the thermal energy in desorption gases in order to determine the amount of effluent that will bypass the regenerative thermal beds 26, 28, 30. Once the VOC-ladened effluent passes through the combustion chamber 32 and is oxidized, it proceeds through one of the regenerative thermal beds (i.e., a bed not currently acting to preheat effluent) and the heat exchanger 18. Finally, the combusted air is then driven by an exhaust fan 58 into the atmosphere. The exhaust fan maintains a constant pressure at the downstream of adsorption unit by means of a pressure controller 60 located along the VOC-ladened effluent conduit. The controller 60 senses the pressure and, in response to a rise or drop in pressure, regulates a variable fix drive for fan 58.

Those of skill in the art will recognize that, by virtue of introduction of the VOC-ladened air into the combustion chamber 32 through the two-position bypass valve 54, the thermal efficiency of the regenerative thermal oxidizer will be reduced. In accordance with the present invention, the thermal efficiency of the regenerative thermal oxidizer is reduced slightly by the direct introduction of solvent-ladened air into the combustion chamber. However, the extra thermal energy required to combust such air is recuperated in the heat exchanger 18 prior to the expulsion of the combustion gasses into the atmosphere. It has been found that a reduction of the thermal efficiency of the regenerative thermal oxidizer from 95% to 85% will supply enough thermal energy to the desorption gas to enable it to effectively remove VOCs from the adsorption unit 14. Thus, an advantage of the present system is the diminution of an additional burner to heat the desorption gas prior to its entry into the adsorption unit. Also, while the thermal efficiency of the regenerative thermal oxidizer is reduced slightly by the addition of the two-position bypass valve 54, the efficiency of the unit is still significantly greater than that of comparable recuperative thermal oxidizing units.

An additional advantage of the method and apparatus of the present invention is the reduction in pressure drop across the regenerative thermal oxidizer 12. Due to the lower required efficiency from 95% to even 90%, the size of the thermal beds may be reduced so that a decrease in the pressure drop across the beds is attained (from 22 inches of water to 14 inches of water).

Moreover, the decrease in pressure drop affects the size and complexity of the system 10. The regenerative thermal beds 26, 28 and 30, as just mentioned, are smaller. The ability to build smaller, and therefore lighter, regenerative thermal beds is particularly valuable considering that regenerative thermal oxidizers are typically placed on the roof of paint spray booth facilities. Thus, significant advantages may be attained in building construction and support costs.

Figure 2:
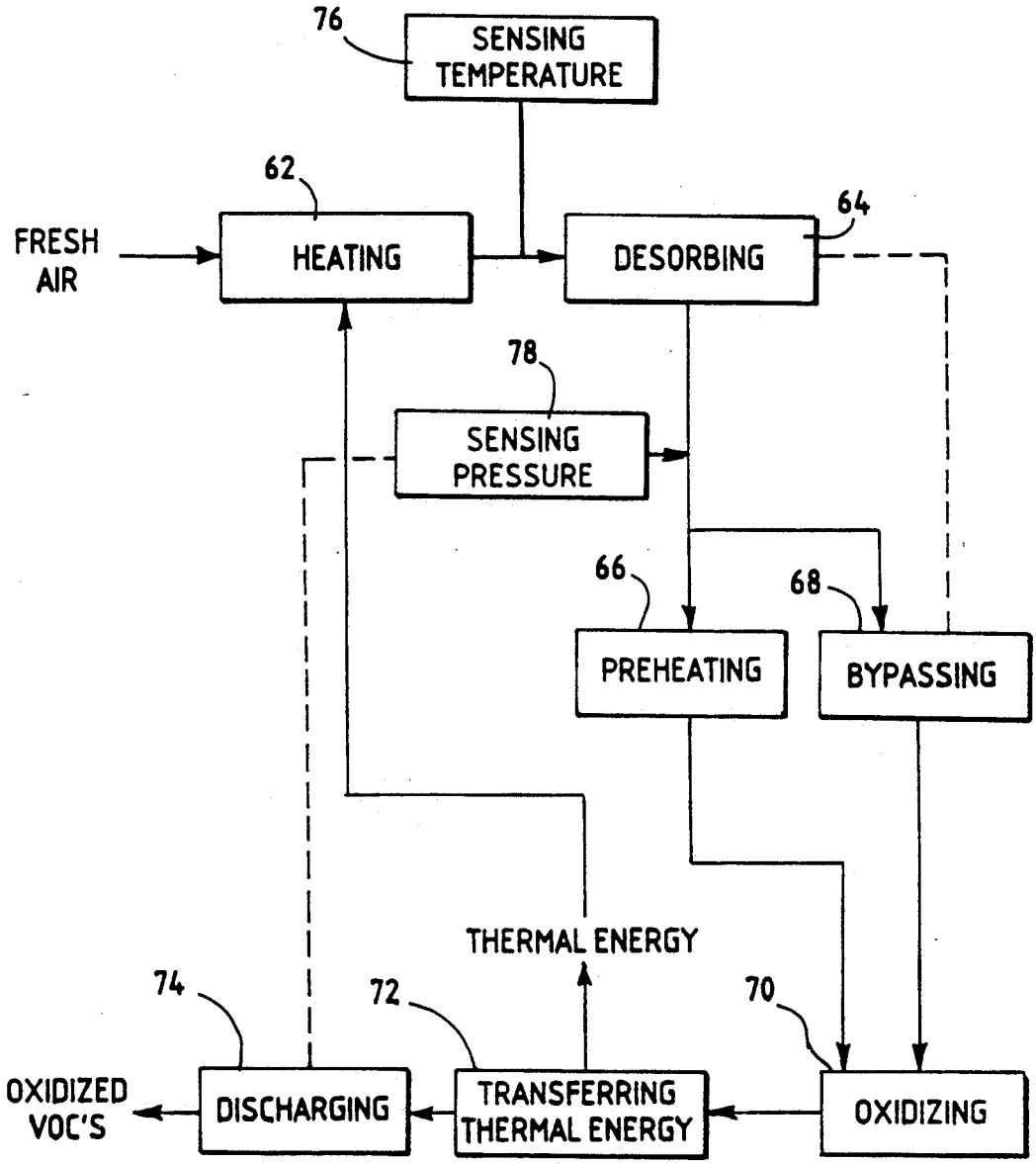
FIG. 2 is a block diagram representing the steps of the method of the present invention.

Referring now to FIG. 2, the steps of the method of the present invention are referred to in block diagram form. Desorption gas (typically, air) is first heated in a heat exchanger 62. The heated desorption gas is then transferred from the heat exchanger to an adsorption unit to remove volatile organic compounds 64. The now VOC laden effluent is introduced from the adsorption unit to a regenerative heating bed for heating prior to combustion 66. The effluent is then directed from the regenerative thermal bed to the combustion chamber for oxidation.

The method also comprises selectively bypassing a predetermined amount of the effluent around the regenerative thermal beds and directly into the combustion chamber 68, thus lowering the thermal efficiency of combustion and requiring excess thermal energy for combustion. The extent to which gases bypass the regenerative thermal beds is determined by sensing the temperature of the desorption gases leaving the heat exchanger 78. For instance, if the temperature of the desorption gases is lower than a preselected desired temperature, a controller will direct the bypass valve to introduce additional effluent around the regenerative thermal beds and directly into the combustion chamber.

Next, the effluent is then oxidized 70. The oxidized effluent is then directed back through a different regenerative thermal bed and through a heat exchanger to transfer heat to desorption gases entering an adsorption unit 72. Finally, the oxidized effluent is discharged into the atmosphere 74. The amount of work used to discharge oxidized effluent into the atmosphere is controlled by sensing the pressure of effluent leaving a desorption unit 78 so as to maintain preselected pressure across the system.

From the foregoing, it will be appreciated that numerous variations and modifications may be implemented without departing from the true spirit and scope of the subject invention. It is understood that no limitation with respect to the specifically described method and apparatus is intended or should be inferred. Rather, it is intended that all such modifications should be included within the scope of the claims.

We claim:

1. A volatile organic compound abatement system comprising:

(a) at least one volatile organic compound adsorption unit;

(b) supply means for inputting a desorption gas flow into said adsorption unit;

(c) heat exchange means associated with said supply means for heating said desorption gas flow in said supply means;

(d) transfer means for carrying a gas flow effluent from said adsorption unit;

(e) a thermal regenerative oxidizing unit comprising a combustion chamber and a plurality of thermal regeneration beds, said unit connected to said transfer means to thereby receive said gas flow effluent in at least one of said regeneration beds;

(f) bypass means coupled with said transfer means for allowing a predetermined portion of said gas flow effluent to circumvent said thermal regeneration beds and pass directly into said combustion chamber;

(g) control means for sensing the temperature of said gas flow in said supply means and selectively activating said bypass means responsive to the temperature sensed; and (h) exhaust means coupled with said thermal regenerative oxidizing unit and associated with said heat exchange means for transferring thermal energy from the exhaust of said thermal regenerative oxidizing unit to said desorption gas flow prior to discharging said exhaust into the atmosphere.

2. The system according to claim 1 wherein said exhaust means further comprises a variable frequency drive fan for discharging the exhaust of the thermal regenerative oxidizing unit.

3. The system according to claim 2 wherein said transfer means further comprises pressure sensing means for maintaining constant pressure within said transfer means through controlling a variable fixed drive fan in response to a pressure drop across the system.

4. The system according to claim 1 wherein said supply means further comprises a heat exchange bypass means for selectively circumventing said heat exchange means.

5. The system according to claim 4 wherein said supply means further comprises a temperature sensing means placed at the input to said adsorption unit for selectively activating said heat exchange bypass means.

6. The system according to claim 1, wherein the control means comprises temperature sensing means attached to said supply means for selectively activating said bypass means to maintain a preselected desorption gas flow temperature.

7. A process for controlling the temperature of gases flowing through a volatile organic compound abatement system, in which a high temperature is consistently maintained in a combustion chamber and the thermal efficiency is selectively lowered in the combustion chamber in order to transfer thermal energy to other portions of the system, comprising the steps of:

(a) introducing desorption gas to a heat exchanger;

(b) sensing the temperature of the desorption gas;

(c) transferring heated desorption gas from the heat exchanger to an adsorption unit to remove volatile organic compounds;

(d) introducing effluent from the adsorption unit into a regenerative heating bed for heating gases prior to combustion;

(e) directing said effluent from the regenerative heating bed to a combustion chamber;

(f) selectively bypassing a predetermined amount of said gases around said regenerative heating bed and into said combustion chamber in response to said sensed temperature, in order to selectively lower the thermal efficiency of combustion and require excess thermal energy for oxidization;

(g) oxidizing said effluent within the combustion chamber, thereafter discharging the combusted effluent from said chamber through another bed;

(h) directing said oxidized effluent through said heat exchanger to transfer thermal energy to said desorption gases entering said adsorption unit;

(i) disposing of said oxidized effluent.

8. The process of claim 7 further comprising sensing the pressure of effluent leaving an adsorption unit, said sensed pressure controlling the amount of work committed to disposing oxidized effluent so as to maintain a preselected pressure.

* * * * *